United States Patent [19]

Grenfell

[11] 4,427,919

[45] Jan. 24, 1984

[54] MERCURY HOLDER FOR ELECTRIC DISCHARGE LAMPS

[76] Inventor: Julian P. Grenfell, Hollybank House, Hollybank Rd., Hook Heath, Woking, Surrey, England

[21] Appl. No.: 286,358

[22] Filed: Jul. 23, 1981

[30] Foreign Application Priority Data

Jul. 30, 1980 [GB] United Kingdom ..... 8024860

[51] Int. Cl.[3] ..... H01J 61/28

[52] U.S. Cl. ..... 313/546; 445/9; 445/18; 313/550

[58] Field of Search ..... 445/6, 9, 18, 31, 55, 445/72, 73, 70; 313/177, 174, 546, 547, 550

[56] References Cited

U.S. PATENT DOCUMENTS

| | | | |
|---|---|---|---|
| 2,288,253 | 6/1942 | Reuter | 250/27.5 |
| 2,322,421 | 6/1943 | Cox | 313/174 X |
| 2,415,895 | 2/1947 | Lopez | 316/14 |
| 2,991,387 | 7/1961 | McCauley | 313/109.5 |
| 3,265,917 | 8/1966 | Ray | 313/174 X |
| 3,300,037 | 1/1967 | De Santis | 206/0.4 |
| 3,544,829 | 12/1970 | Someya et al. | 313/174 X |
| 3,764,842 | 10/1973 | Ridders et al. | 313/177 |
| 3,794,402 | 2/1974 | Ridders et al. | 316/14 |
| 3,895,709 | 7/1975 | Przybylek | 206/84 |
| 3,913,999 | 10/1975 | Clarke | 316/4 |
| 3,983,439 | 9/1976 | Blommerde et al. | 313/174 |
| 4,056,750 | 11/1977 | Latassa | 313/177 |
| 4,127,790 | 11/1978 | Kuus et al. | 313/174 X |
| 4,182,971 | 1/1980 | Cassidy et al. | 313/177 |
| 4,272,702 | 6/1981 | Teshima et al. | 313/174 X |

FOREIGN PATENT DOCUMENTS

| | | |
|---|---|---|
| 445578 | 10/1934 | United Kingdom . |
| 444934 | 7/1935 | United Kingdom . |
| 440999 | 8/1935 | United Kingdom . |
| 441985 | 8/1935 | United Kingdom . |
| 462356 | 8/1935 | United Kingdom . |
| 573232 | 12/1943 | United Kingdom . |
| 2040554 | 8/1980 | United Kingdom . |
| 2063556 | 6/1981 | United Kingdom . |

*Primary Examiner*—Kenneth J. Ramsey

*Attorney, Agent, or Firm*—Kerkam, Stowell, Kondracki & Clarke

[57] ABSTRACT

A mercury holder for electric discharge lamps, such as tubular fluorescent lamps, is mounted within the lamp envelope so as to serve as a target for bombardment by electrons and ions. The source of the bombardment may be the electrons emitted by one of the cathodes which impinge on the holder and which generate ions by collision with the gas fill in the lamp envelope. Alternatively, the source of the bombardment may be an arc discharge induced by a radio-frequency source across a gap between the holder and a lead-in conductor.

4 Claims, 3 Drawing Figures

FIG.1
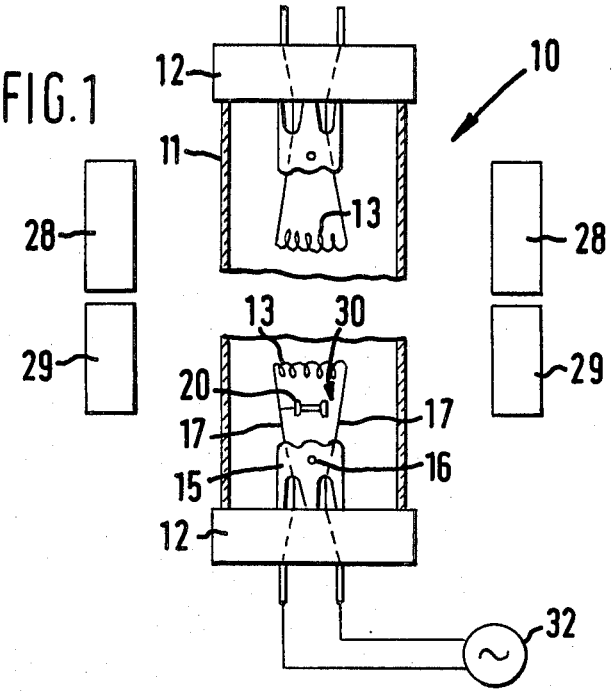
FIG.2
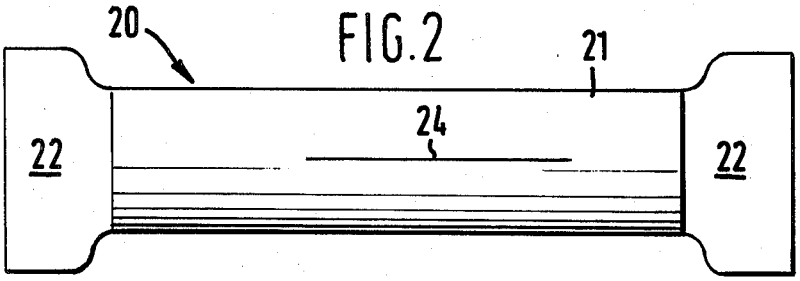
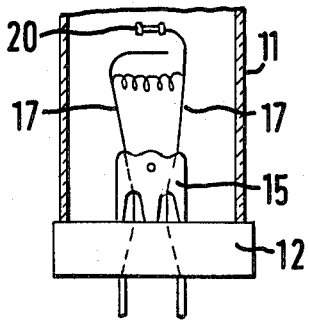
FIG.3

MERCURY HOLDER FOR ELECTRIC DISCHARGE LAMPS

This invention concerns a mercury holder for electric discharge lamps, especially lamps having a sealed transparent or translucent envelope containing at least one cathode, at least one gas at substantially reduced pressure and a certain amount of mercury. Such discharge lamps include fluorescent lamps and low pressure mercury discharge lamps, but may also include cold cathode glow discharge tubes.

In the manufacture of fluorescent tubes the introduction of an accurately metered amount of mercury into an already sealed and evacuated lamp envelope presents a great problem, not only technologically but also from the point of view of preventing the escape of mercury which is, of course, biologically toxic.

The conventional technique involves the use of an electromagnetic valve dispenser to dispense a more-or-less accurately controlled amount of liquid mercury into a portion of an exhausting machine adjacent the exhaust tube (sometimes referred to as "tubulation") and then blowing or dropping the droplet of mercury into the interior of the envelope by means of a stream of argon, which is also the fill gas. This technique suffers from several drawbacks. Firstly, the dispenser cannot dispense an exact amount of mercury. Secondly, tiny amounts of mercury may never reach the tube envelope but may instead get stuck along the dispensing path, e.g. in the dispenser itself or in the exhaust tube. Thirdly, as the dispensing takes place in a hot environment evaporation losses may occur. Because of these disadvantageous factors the amount of mercury usually dispensed considerably exceeds the actually desired amount and this is wasteful of a not inexpensive raw material of finite abundance. Furthermore, on breakage of a tube, excessive amounts of harmful mercury may escape into the environment.

One prior proposal to overcome this drawback is to mount a piece of mercury amalgam around the cathode, on an anti-sputtering cathode shield, before tipping-off the exhaust tube. After tipping-off the mercury is vaporised from the amalgam by external indirect heating. While this method allows the dosage of mercury to be controlled better and reduced in magnitude, production is rendered more difficult and also more expensive. Furthermore, in fluorescent tubular lamps made in some countries, e.g. the USA, such cathode shields are normally not provided at all.

In another prior proposal, (U.S. Pat. No. 3,764,842) the required amount of mercury is sealed into a glass holder or capsule (these two terms are hereafter used interchangeably) in heat-conducting contact with an outer heater wire in which a current is generated by induction to melt and cut through the glass wall, whereby to release the mercury. The capsule and wire are mounted on the anti-sputtering ring or shield disposed about the cathode. The drawback is that the assembly and mounting of the capsule and heater wire are rather intricate, and special measures have to be taken to prevent pieces of broken glass from falling off. The anti-sputtering shield also requires special shaping.

In yet other prior proposals, e.g. U.S. Pat. Nos. 3,794,402 and 4,182,971 a glass or metal capsule containing mercury has a sealed-in heating filament extending longitudinally through its interior. It is either connected to an external current source by way of current supply conductors passing through a wall of the tube, or a current is induced in it from a radio-frequency source. The heating current vaporises the mercury and the capsule cracks by the effect of the increased vapour pressure. The capsule may or may not be mounted about an anti-sputtering shield but it has the disadvantage that it requires additional lead-in wire(s) through the wall of the tube or an R.F. heater. Also the preparation of the capsule with a metal wire sealed in it is too cumbersome and expensive.

In the known proposals employing capsules, the physical mechanism of releasing the mercury is either by direct cutting through a glass wall requiring special measures to prevent glass chips from falling into the envelope or rupture of the capsule by mercury vapour pressure due to internal heating.

The present invention seeks to overcome the drawbacks of prior proposals and to provide an improved mercury dispenser mountable in electric light sources such as fluorescent lamps and others. The invention is based on the exploitation of the kinetic energy of particles, such as electrons and ions, by using them to bombard, and so to heat up and burst, the capsule and release the mercury in it. The particles bombardment has its source in electron emission from a cathode and the ionisation of the gases(es) in the envelope or tube.

According therefore to one aspect of the present invention there is provided an electric light source comprising a sealed translucent or transparent envelope containing a fill gas and cathode means connectable to an external source of current by way of lead-in conductors, a holder containing a predetermined volume of mercury made from a material which is electrically conductive, the holder being in use so mounted within the envelope as to serve as a target for electronic and/or ionic bombardment, whereby to heat and vaporise the mercury in the holder to burst the latter, the source of such bombardment being internally of the said envelope.

In a preferred embodiment, the said source of the bombardment is the cathode means; more particularly, where the capsule or holder is adjacent the cathode at one end of a tubular fluorescent lamp, then the source is the cathode at the opposite end, the holder being anodically connected relative to the cathode means, e.g. to one of the lead-in conductors of one of the cathode means. The other cathode is then connected in an electrical circuit to energise it to emit electrons towards the anodically functioning holder and to generate ions by collisions with gas molecules in the envelope.

To promote impact on the holder of the emitted electrons, and of the ions arising from collisions between the electrons and atoms of the fill gas, external magnetic, electromagnetic and/or electrostatic focusing means are preferably provided.

In certain types of fluorescent lamps, the lead-in wires are extended beyond their connection with the cathode filament and are then bent inwardly to serve as a shield to protect the filament from high velocity ion bombardment, which can knock "chips" out of the filament. In such lamps the capsule may expediently be mounted on one of the inwardly bent lead-in ends. The capsule then plays the dual role of mercury dispenser and cathode shield.

In a preferred embodiment, the capsule has at least one portion of reduced wall thickness to promote its rupture. The capsule may be an essentially annular member having flattened or crimped ends constituting two such portions. Additionally or alternatively the annular member has a weakened portion intermediate the ends thereof. The preferred material for the holder is nickel. For use in a fluorescent lamp the holder of capsule has a preferred wall thickness of, typically, 0.15 mm and a length of, typically, 10 mm containing about 25 mg of mercury, and such a holder or capsule would readily burst at 850° C.

According to another preferred embodiment of the invention, a mercury-containing holder is secured to one of the lead-in conductors of a discharge lamp and extends transversely towards the other, or another, lead-in conductor so that a gap exists between the latter and the adjacent end of the holder (or a wire extending from the said end of the holder), and the lead-in conductors are connected to a radio-frequency electrical source the frequency of which is so chosen that the dynamic impedance of the cathode means connected between the lead-in conductors at that frequency is sufficiently high for an electrical discharge or arc to form across said gap, whereby the holder is heated by particle bombardment to release the mercury. The said frequency may be so chosen that the holder, possibly with the associated wire(s) at its end(s), functions in effect as a quarter-wave antenna.

In all the above-described aspects and preferred embodiments of the invention means may be provided to monitor the discharge to detect the modification in its characteristics as a result of the mercury being released, in order to switch off the power supply.

In a further aspect of this invention, there is provided a method of dosing electric light sources with mercury by the provision of a sealed metallic holder substantially filled with mercury, and heating the holder by particle-/ionic bombardment the source of which is a gas discharge generated within the envelope.

Preferred embodiments of the invention will be illustrated, purely by way of example, with reference to the accompanying diagrammatic drawing, wherein:

FIG. 1 is a part elevation, part cross-section of a tubular fluorescent lamp including a mercury holder/-dispenser, according to a first preferred embodiment of the present invention, FIG. 2 is an enlarged elevational view of the mercury holder shown in FIG. 1, and FIG. 3 corresponds to FIG. 1 but shows a modification.

Referring to FIGS. 1 and 2 of the drawing, there is shown a fluorescent lamp 10 comprising a transparent or translucent tubular envelope 11, end caps 12, cathode means (which may be a single cathode or a double cathode, hereafter, referred to simply as "cathode") 13; a stem including a pinch 15 and an exhaust hole 16, and a pair of lead-in wires 17 connected to the cathode 13 and sealed in and extending through the pinch 15. The structure so far is conventional.

According to the first preferred embodiment of the invention one of the lead-in wires 17 is connected by way of a short wire 19 projecting laterally towards the other lead-in wire, with a gap 30 therebetween. The structure of the holder 20 is described in greater detail with reference to FIG. 2 below. A radio frequency source 32 is connected between the two lead-in wires 17. If the frequency of the source 32 is chosen suitably, having regard to the electrical parameters of the cathode 13 (i.e. Q-factor, inductance, resistance) and having regard also to the effective length of the dispenser 20 from its junction to the lead-in wires 17 to the gap 30, a voltage may be applied across the gap 30 which is sufficient to cause a breakdown of the "atmosphere" in the envelope 11 and a current to flow across the gap 30. The resulting particles (electrons, ions) will bombard the capsule 20, cause it to heat up and to release the mercury which has vaporised therein. Although this is not shown, the end of the holder 20 next to the gap 30 may also include a short wire extending laterally; by such an expedient the overall length of the "quarter-wave antenna" referred to above can be set to a desired value.

Referring finally in FIG. 3, there is shown one end of a fluorescent lamp having a cathode structure wherein the lead-in wires 17 are continued axially beyond the plane of the filament 13 and then bent inwardly towards each other in an overlapping or juxtaposed relationship. Such a structure is known in itself. It serves as an anodic shield to stop high velocity ionic bombardment of, and thus damage to, the filament 13.

In the present embodiment of the invention such a structure is modified by securing the mercury capsule 20 according to FIG. 2 and holding a predetermined volume of mercury on one of the extended lead-in wire portions. In this way the capsule 20 acts as a target for the ions and electrons from the cathode at the opposite end of the tubular envelope 11. Thus, in use, the capsule 20 will heat up and burst, to release the mercury. Furthermore, the mercury dispenser 20 is illustrated in greater detail in FIG. 2. It is essentially a hermetically sealed, annular or tubular body 21 made e.g. of nickel and provided with two flattened or crimped ends 22 for connection to the wire 17. The interior of the body 21 holds an accurately dosed amount of liquid mercury.

In a typical but non-limitative example, the wall thickness of the body 21 is 0.15 mm, its length is 10 mm, its inner diameter is 0.05 mm and contains 25 mg of mercury.

The body 21 may be provided with a weakening 24, e.g. by scoring its wall, but this is not essential.

In use, the lamp is sealed, exhausted and tipped off with the dispenser 20 mounted as shown in FIG. 1. The cathode at the other end of the tube 11 is energised from an external power source to emit electrons some of which collide with atoms of the fill gas to produce ions. The capsule 20 is connected anodically. With the aid of external focusing means 28 and beam-deflecting means 29 the will be targeted or focused on the capsule 20 electronic and ionic bombardment to heat it up sufficiently to vaporise the mercury in it. The capsule will burst (but not disintegrate into pieces) to release the mercury and the mercury vapour to pass into the lamp envelope 11. The means 28 and 29 utilize electromagnetic and/or electrostatic fields.

The preferred embodiments of the invention have the following advantages:

(a) Accurate dosage of just the right amount of mercury and no more.

(b) There is no danger of broken glass or other pieces of material of the holder remaining loose in the light source, which might damage the sensitive phospher coating on the interior of the wall.

(c) The holder is not as frangible as prior art capsules and is therefore simpler to fabricate, manipulate and mount in position.

(d) The mercury holder is suitable for use with the method and apparatus disclosed in our British Pat. No. 1554067 as well as with conventional methods and apparatus.

(e) The mercury holder according to this invention is usuable in fluorescent lamp structures in which an anti-sputtering shield is not provided.

(f) If desired and as an optional feature to aid the bursting of the capsule, the latter may be so dimensioned as to be full, or substantially full, when the predetermined volume of mercury is held therein. Now the volume coefficient of thermal expansion of mercury is an order of magnitude greater than that of the nickel body 21 and the volume difference amounts to approximately 12% at about 850° C. This difference is sufficient to burst the nickel body 21 either at the crimped ends 22 or at the weakening 24.

I claim:

1. An electric light source comprising a sealed transparent elongated envelope containing a fill gas, a cathode at each end of said elongated envelope, lead-in conductors connected to each said cathode and connectable to an external source of electric current, a holder containing a predetermined volume of mercury mounted within the envelope at one end thereof and being anodically connected relative to the cathodes by being connected to one of the lead-in conductors of one of the cathodes, the other cathode being connected in an electrical circuit effective on energisation to cause said other cathode to emit electrons towards the anodically functioning holder and to generate ions by collisions with gas molecules in the envelope, whereby the said holder heats up under the electronic and ionic bombardment and bursts to release the mercury.

2. An electric light source as claimed in claim 1 wherein the said lead-in conductors of said one cathode are extended in a generally axial direction beyond their connection with the said one cathode and are then bent transversely to serve as a shield to protect the said one cathode from high velocity ion bombardment, the said holder being mounted on the end of the transversely bent lead-in conductors.

3. An electric light source as claimed in claim 1 wherein means disposed externally of the said envelope are provided to focus and direct the bombarding particles onto the said holder.

4. An electric light source comprising a sealed transparent elongated envelope containing a fill gas, a cathode at each end of said elongated envelope, lead-in conductors connected to each said cathode and connectable to an external source of electric current, a holder containing a predetermined volume of mercury mounted within the envelope at one end thereof, wherein the said holder is secured to one of the lead-in conductors connected to said one cathode and extends transversely towards, but terminates before, the other lead-in conductor of said one cathode so as to define a gap between said other lead-in conductor and the adjacent end of the holder, and the said lead-in conductors are connected to a radio-frequency electrical source the frequency of which is so chosen that the holder functions as a quarter-wave resonant antenna to generate an electrical discharge across said gap, whereby the holder is heated by particle bombardment to release its mercury contents.

* * * * *